US005803411A

United States Patent [19]

Ackerman et al.

[11] Patent Number: 5,803,411

[45] Date of Patent: Sep. 8, 1998

[54] METHOD AND APPARATUS FOR INITIALIZING AN AUTOMATED TRAIN CONTROL SYSTEM

[75] Inventors: Joseph R. Ackerman, West Mifflin; Kenneth A. Karg, Belle Vernon; Angela C. Patel, Churchill, all of Pa.

[73] Assignee: ABB Daimler-Benz Transportation (North America) Inc., Pittsburgh, Pa.

[21] Appl. No.: 734,120

[22] Filed: Oct. 21, 1996

[51] Int. Cl.[6] ..... B61L 3/02

[52] U.S. Cl. ..... 246/169 R; 246/4; 246/182 B; 701/19; 701/29

[58] Field of Search ..... 246/3, 4, 15, 122 R, 246/167 R, 169 R, 182 B; 364/424.03, 426.04, 426.05; 701/19, 20, 29

[56] References Cited

U.S. PATENT DOCUMENTS

| | | | |
|---|---|---|---|
| 3,268,727 | 8/1966 | Shepard | 246/187 |
| 3,377,616 | 4/1968 | Auer, Jr. | 340/23 |
| 3,470,370 | 9/1969 | Landow | 246/122 |
| 3,636,331 | 1/1972 | Amrehn | 235/151.12 |
| 3,639,753 | 2/1972 | Reich | 246/182 C |
| 3,639,754 | 2/1972 | Kovalcik | 246/182 B |
| 3,655,962 | 4/1972 | Koch | 246/182 C |
| 3,662,167 | 5/1972 | Elcan et al. | 246/2 F |
| 3,800,139 | 3/1974 | Clark | 246/182 C |
| 3,888,437 | 6/1975 | Birkin | 246/63 A |
| 3,891,167 | 6/1975 | Perry | 246/34 R |
| 3,895,584 | 7/1975 | Paddison | 104/88 |
| 4,005,837 | 2/1977 | Grundy | 246/182 B |
| 4,005,838 | 2/1977 | Grundy | 246/182 B |
| 4,155,526 | 5/1979 | Noble | 246/249 |
| 4,217,486 | 8/1980 | Tawfik et al. | 371/68 |
| 4,432,229 | 2/1984 | Nowogrodzki | 73/146 |
| 4,467,430 | 8/1984 | Even et al. | 364/436 |
| 4,532,511 | 7/1985 | Lemelson | 340/933 |
| 4,610,206 | 9/1986 | Kubala et al. | 104/26 B |
| 4,700,292 | 10/1987 | Campanini | 364/200 |
| 4,735,383 | 4/1988 | Corrie | 246/3 |
| 4,768,740 | 9/1988 | Corrie | 246/2 S |
| 4,819,168 | 4/1989 | Laskey | 364/424.01 |
| 4,882,669 | 11/1989 | Miura et al. | 364/184 |
| 4,904,939 | 2/1990 | Mian | 324/229 |
| 4,944,474 | 7/1990 | Jones | 246/122 R |
| 4,945,753 | 8/1990 | Twombly | 73/2 |
| 4,994,969 | 2/1991 | Petit | 364/424.01 |
| 5,008,805 | 4/1991 | Fiebig et al. | 364/184 |
| 5,029,294 | 7/1991 | Kim | 340/988 |
| 5,036,478 | 7/1991 | MacDougall | 364/562 |
| 5,036,935 | 8/1991 | Kohara | 180/168 |
| 5,053,964 | 10/1991 | Mister et al. | 364/424.01 |
| 5,136,516 | 8/1992 | Twombly | 364/426.05 |
| 5,267,173 | 11/1993 | Tanizawa et al. | 364/478 |
| 5,329,449 | 7/1994 | Tanizawa et al. | 364/424.02 |
| 5,332,180 | 7/1994 | Peterson et al. | 246/3 |
| 5,353,413 | 10/1994 | Novakovich et al. | 395/325 |
| 5,364,047 | 11/1994 | Petit et al. | 246/122 R |
| 5,369,591 | 11/1994 | Broxmeyer | 364/461 |
| 5,371,859 | 12/1994 | Lennartsson | 395/325 |
| 5,390,880 | 2/1995 | Fukawa et al. | 246/167 R |
| 5,398,894 | 3/1995 | Pascoe | 246/28 R |
| 5,440,489 | 8/1995 | Newman | 364/426.05 |

*Primary Examiner*—S. Joseph Morano
*Attorney, Agent, or Firm*—Webb Ziesenheim Bruening Logsdon Orkin & Hanson, P.C.

[57] ABSTRACT

A vehicle initialization system for a control system that includes a vehicle, such as a train that is to be initialized, a vehicle track, a first reader, an onboard computer and a tachometer. The vehicle is adapted to coact with the track. At least two spaced apart position identifiers are positioned along the track. The first reader attaches to the vehicle and is adapted to read information from the position identifiers and relay the information to the onboard computer. The tachometer is also interfaced with the onboard computer, so that as the vehicle passes the position identifiers, the tachometer can be calibrated and the vehicle direction of travel and the vehicle orientation can be determined. The system also includes a vehicle identifier adapted to identify the vehicle characteristics. A second reader is positioned along the track and is adapted to read the vehicle identifier as the vehicle travels along the track. A wayside computer interfaces with the second reader. A wheel detector and a trip stop for preventing the vehicle from proceeding along the track are provided along the track and are interfaced with the wayside computer. The trip stop prevents the vehicle from proceeding on the track if information transmitted by the vehicle identifier is not verified by the wheel detector.

42 Claims, 6 Drawing Sheets

METHOD AND APPARATUS FOR INITIALIZING AN AUTOMATED TRAIN CONTROL SYSTEM

BACKGROUND OF THE INVENTION

1) Field of the Invention

This invention relates to train control, and more particularly, to a system and method for introducing a contactless train onto a system.

2) Description of the Prior Art

Presently, railroads, mass transit and people mover systems that include a train traveling along a track, utilize a fixed block system. In theory, the fixed block system divides the track into a plurality of sections or blocks. Only one train can travel in a respective block at a time. Typically, the wayside system determines whether a train can travel in the next block. Contact-type trains include a contact mechanism, either metallic wheels or a brush attached to the train. The contact shorts out an electrical line provided on the track which, in turn, identifies the train location on the track.

The fixed block system inefficiently utilizes the train track and typically is used in a contact-type of train system. Trains cannot closely follow each other, even under the safest conditions, if the distance between the trains conflicts with the block spacing. This is a particular problem with mass transit, such as subways and people movers, and results in unnecessarily limiting the number of trains on the track, especially during peak traffic times. When the traffic runs slower, the trains cannot run closer to each other at a safe distance because the blocks are laid out to space the trains apart under worst case conditions.

Recently, the railroad industry has identified the moving block system as a solution to the fixed block problem. The moving block system does not divide the track into fixed sectors. Rather, a safety distance profile is developed for each train based upon information related to the train's speed, weight, braking information, and train model or design type. This information is then supplied to a control computer which determines a safety distance profile, which is the closest distance adjacent trains can be operated. See, for example, U.S. Pat. Nos. 5,364,047 and 4,711,418. This safety distance profile continually changes and depends on the train speed, the specific train design and the topography of the track. Moving block systems improve performance and safety over fixed block systems.

A necessary component of the moving block system is a control computer or control computers which dictate the appropriate speed and the braking profile of the train or trains. It is important that the control computers include a full or partial map of the system and have the ability to locate the train's location. In an ideal situation, the same trains always travel on the same track. However, in actuality, the trains must be added and removed from the tracks, and at times, train cars must be added or removed from the trains. All of this information must continuously be updated and supplied to a stationary control computer or control computers. This is especially important when a train travels from a spur or secondary portion of the track to the primary or main portion of the track where other trains are traveling.

It is of the upmost importance that the control computer (or control computers) receives accurate information of the train regarding the train's length and performance characteristics of the train cars, orientation and direction of travel before that train can be permitted to enter the main portion of track where other trains are traveling. Also, it is important that the train's distance measuring device, be it either a tachometer or Doppler radar, for example, is accurately calibrated before the train enters the main portion of the track so that the control computer (or control computers) can accurately and safely control the train.

Therefore, it is an object of the present invention to safely introduce trains to the main portion of the track in a contactless moving block system.

SUMMARY OF THE INVENTION

The present invention is a vehicle initialization system for a control system that includes a vehicle to be initialized, a vehicle path adapted to coact with the vehicle and at least two spaced apart position identifiers positioned along the path. Each of the position identifiers is adapted to represent information identifying a location in the vehicle's path. An onboard reader attaches to the vehicle and is adapted to read information from the position identifier. An onboard computer provided on the vehicle is interfaced with the onboard reader. The onboard computer is adapted to receive data from the onboard reader. A device for measuring the distance the vehicle has traveled, such as a tachometer, is interfaced with the onboard computer. The position identifiers identify location information to the onboard reader when the vehicle passes the position identifiers. The onboard reader relays the location information as data, which is inputted into the onboard computer so that the onboard computer determines the vehicle direction of travel and a distance between the position identifiers and the onboard computer calibrates the device for measuring the distance the vehicle has traveled. The onboard computer also determines the orientation of the vehicle based upon the direction of travel calculated previously and the rotational direction information the onboard computer receives from the device for measuring the distance the vehicle has traveled.

The present invention can also include an onboard vehicle identifier adapted to identify vehicle characteristics, a second reader, a wayside computer, an identifying device for identifying at least one characteristic of the vehicle as the vehicle travels along the vehicle path and a device for preventing the vehicle from proceeding along the vehicle path. A vehicle identifier is attached to the vehicle to identify the vehicle. The second reader is positioned along the vehicle path and is adapted to receive signals from the vehicle identifier as the vehicle travels along the vehicle path. The wayside computer is interfaced with the second reader and is adapted to have data read from the second reader inputted therein. The data identifies characteristics of the vehicle. The identifying device, which can also be a wheel detector or other form of vehicle presence detection, is interfaced with the wayside computer. The device for preventing the vehicle from proceeding along the vehicle path, which can be a trip stop, prevents the vehicle from proceeding if the vehicle characteristic identified by the identifying device does not correspond with one of the vehicle characteristics identified by the vehicle identifier.

Another aspect of the invention is a method for initializing a vehicle on a vehicle path, including the steps of: positioning a vehicle on a vehicle path; moving the vehicle on the vehicle path; transmitting vehicle characteristics from the vehicle; reading the vehicle characteristics information; verifying at least one of the vehicle characteristics; and stopping the vehicle if at least one of the vehicle characteristics is not verified.

Another aspect of the invention is a method for initializing a vehicle on a vehicle path, including the steps of: positioning a vehicle on a vehicle path; moving the vehicle on the vehicle path; moving the vehicle over a first fixed point of reference; identifying the location of the first fixed point; moving the vehicle over a second fixed point of reference; identifying the location of the second fixed point; measuring the distance between the first fixed point and the second fixed point by a distance measuring device provided on the vehicle; calculating the distance traveled by the vehicle between the first fixed point and the second fixed point, based upon the identified locations; calibrating the distance measuring device so that the measured distance between the first fixed point and the second fixed point equals the calibrated distance; determining the orientation of the vehicle using the distance measuring device; and determining the vehicle's direction of travel based upon the sequence the vehicle passes over the fixed points.

In another aspect of the invention, the vehicle initialization system for a control system includes the vehicle to be initialized, a vehicle path adapted to coact with the vehicle, and a vehicle identifier attached to the vehicle and adapted to identify characteristics of the vehicle. A reader positioned along the vehicle path is adapted to read the vehicle identifier as the vehicle travels along the path. A wayside computer interfaced with the reader is adapted to have data relayed from the reader inputted therein. The vehicle also includes a train-length trainline adapted to identify characteristics of the vehicle. A vehicle computer provided with the vehicle is interfaced with the train-length trainline. The vehicle computer is adapted to identify characteristics of the vehicle from the train-length trainline. An arrangement is provided for preventing the vehicle from proceeding down the vehicle path if the vehicle characteristics identified by the vehicle computer does not correspond with one of the vehicle characteristics identified by the wayside computer.

In another aspect of the invention, the vehicle computer and the wayside computer compare vehicle characteristics obtained from two sources and prevent the vehicle from proceeding along the vehicle path if the vehicle computer or wayside computer determines the vehicle characteristics obtained from the two sources do not coincide.

DESCRIPTION OF THE PREFERRED EMBODIMENTS

Figure 1:
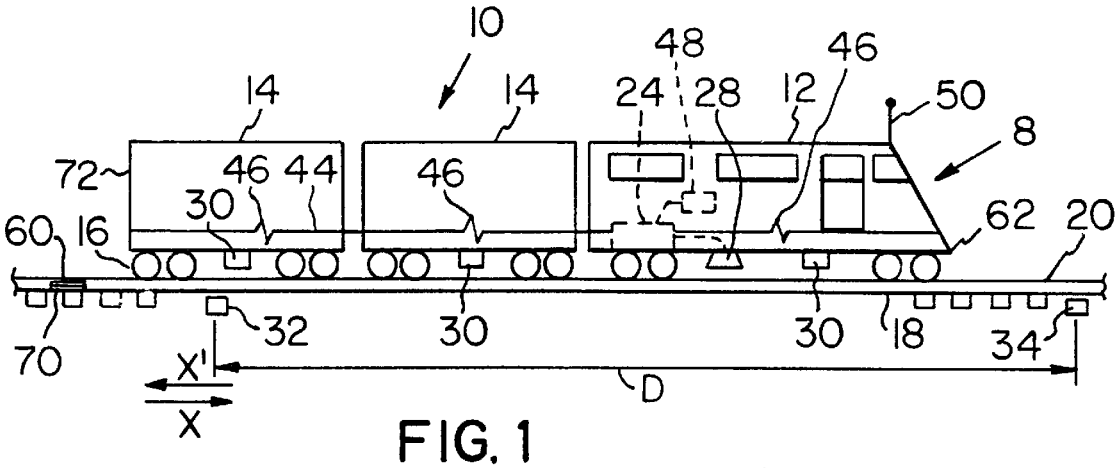
FIG. 1 is a side elevational view of a train positioned on a spur portion of a train track showing a portion of an initialization system for an automated train control system made in accordance with the present invention.
Figure 3:
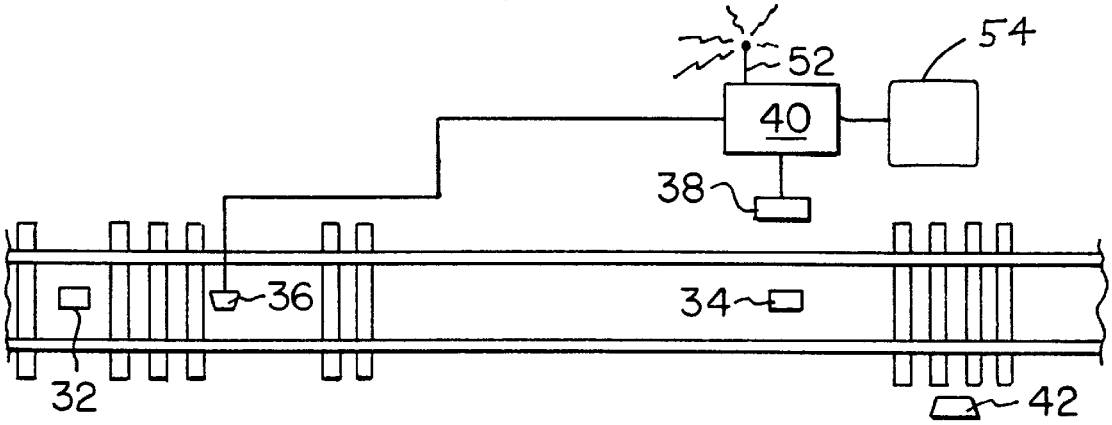
FIG. 3 is a top plan view of the spur portion of the track shown in FIG. 1.
Figure 2:
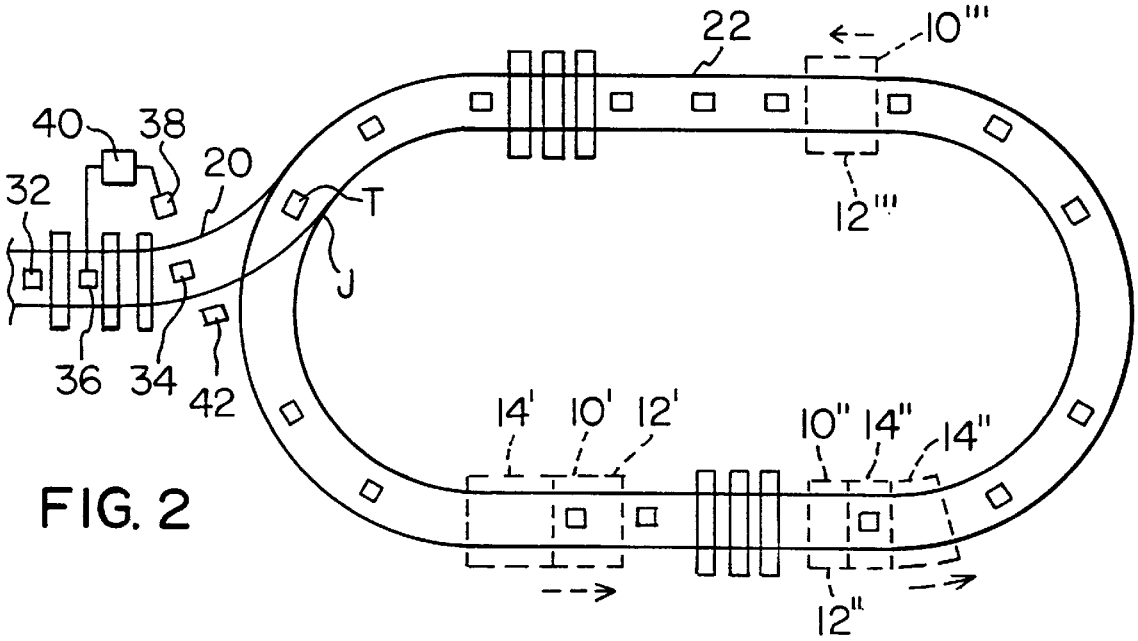
FIG. 2 is a top plan view of a train track including the spur portion shown in FIG. 1.

FIGS. 1–3 show an initialization system 8 for a vehicle control system made in accordance with the present invention. FIG. 1 shows a train 10 made up of one or more vehicles 12 and 14 that includes one or more vehicles equipped with train control equipment. The train 10 can be either part of an automated vehicle control system or a manually operated vehicle control system. Preferably, the present system is to be used in conjunction with a contactless-type system, although aspects of the present invention may be used with a contact-type system. The vehicles 12 and 14 each include a body having a plurality of wheels 16 that coact with a rail or track 18 which defines a vehicle path. The wheels 16 are rotatably secured to the car bodies through axles. The track includes a spur or secondary portion 20 connected to a main or primary portion 22.

An onboard computer 24 provided in at least one of the vehicles, e.g., vehicle 12, is a microprocessor based automated control system that controls the propulsion and brakes and can be configured to control the train stopping and speed control of the train 10. Such a control system can be of the type disclosed in U.S. Pat. No. 5,364,047, which is hereby incorporated by reference. The onboard computer 24 automatically tracks the train location and may or may not provide train protection and/or train speed control. It includes databases for vehicle characteristics, braking performance and engine performance. The onboard computer 24 also includes a map database that represents the track layout, civil speed limits, track grades, locations of all of the train stations positioned along the track and any other relevant position data.

Ideally, the onboard computers 24 of all of the vehicles in the trains 10', 10", and 10'" (which are shown in phantom in FIG. 2) traveling on the main portion 22 of the track 18 are sent information relating to other trains traveling on the main portion 22. In this arrangement, information regarding the train length and the train performance characteristics are of particular importance if the moving block system is to be implemented. Incorrect information can cause an accident. However, trains always enter and leave the main portion 22 of the track 18 for various reasons (maintenance or over capacity, for example). Therefore, there is a need to update the vehicle control system when these changes occur.

The present invention addresses this need by initializing a train's onboard computer 24 prior to permitting the train to enter the main portion 22 of track 18, where a plurality of equipped trains may be traveling. This initialization involves several factors, namely, establishing the location of the train, determining the train length, the train direction, the train orientation and calibrating the train's distance measuring device(s).

Figure 4:
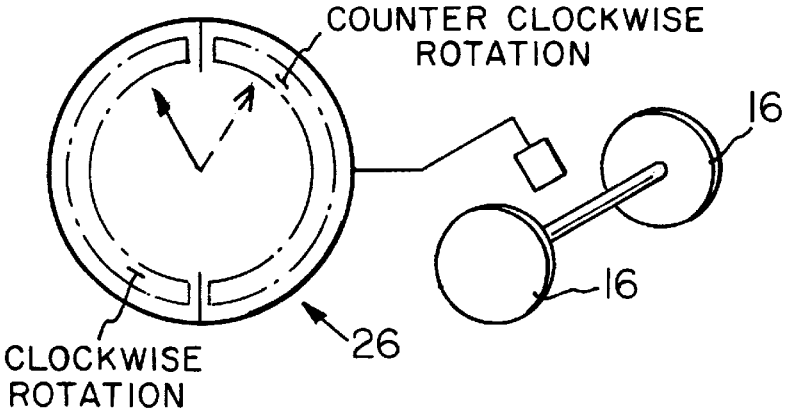
FIG. 4 is a schematic view of a tachometer used in the present invention.

The train 10 includes a tachometer 26, as shown in FIG. 4. The tachometer 26 measures the rotational displacement and direction of one of the train axles attached to the wheels 16. The tachometer 26 is coupled to the appropriate instrumentation so as to measure rotational displacement and direction. The tachometer is also coupled to the onboard computer 24. Specifically, the distance the train has traveled over a fixed period of time equals the number of axle rotations multiplied by the circumference of the wheels 16 attached to the axle. The accuracy of tachometers decreases over a period of time due to wheel wear and mechanical wear of the tachometer.

The vehicle control system includes tags "T", (also known as beacons, position identifiers, transmitters or transponders, spaced along the main portion 22 of the track 18) as shown in FIG. 2. Referring back to FIG. 1, a train reader, receiver or interrogator 28 is secured to a vehicle 12 and is adapted to read or receive signals emitted from tags "T" that represent identifying an exact location of the tag "T" positioned along the main portion 22 of the track 18. Two spaced apart initialization tags 32 and 34 are provided on the spur portion 20 of the track 18, as shown in FIGS. 1–3. Tags 32 and 34 are spaced apart a distance "D". The reader 28 is also adapted to read signals from tags 32 and 34 in a similar manner as it reads signals from tags "T". This information or data is then sent or relayed to and inputted into the onboard computer 24.

The above-described tag/reader system is a radio-based communication system, which uses radio frequency (RF) communication between the vehicle reader 28 and tags "T", 32 and 34. The tag/reader system could also be optically based or inductively based. Each tag "T", 32 and 34 is a passive transponder, encoded with a unique identification, which is excited by RF energy from vehicle-based reader 28. The location information is received by the reader and is then sent to the onboard computer 24 so that the train's location can be pinpointed by the onboard computer map. The onboard tachometer 26 provides displacement information to the onboard computer 24 when the train 10 travels between the tags "T", 32 and 34.

In addition to tags provided along the train track 18, each train's vehicles 12 and 14 includes vehicle tags, transmitters or vehicle identifiers 30 attached to undersides of the car bodies, as shown in FIG. 1. Tags 30 are similar to tags "T", 32 and 34, except the information contained on the tags 30 is directed to the car physical information, such as the type or model of the train car, the train car physical characteristics, the number of axles provided on the train car and the train car length. A verification reader, interrogator or receiver 36, which is similar to reader 28, is positioned along the spur portion 20 of the track 18. The verification reader 36 is adapted to receive or read encoded information or signals transmitted by the tags 30 and is operated in a similar manner as reader 28.

A wheel detector 38, which is well known in the art, is positioned adjacent to the spur 20. The wheel detector 38 identifies or detects the number of axles on a train that passes the wheel detector 38. The wheel detector 38 and the verification reader 36 are coupled or interfaced to a wayside computer 40 so that information from the wheel detector 38 and the verification reader 36 can be relayed to the wayside computer 40. A trip stop 42 is positioned along the spur portion 20 just prior to a junction "J" where the spur portion 20 meets the main portion 22, as shown in FIG. 2. The trip stop 42, which is well known in the art, includes a mechanical arm that is adapted to contact a lever on the train that activates the train brakes. The trip stop 42 is coupled to the wayside computer 40.

The onboard computer 24 and the wayside computer 40 each include a bidirectional communication device, such as a radio frequency transceiver, which enables information to be transmitted and received between the onboard computer 24 and the wayside computer 40.

Figure 5:
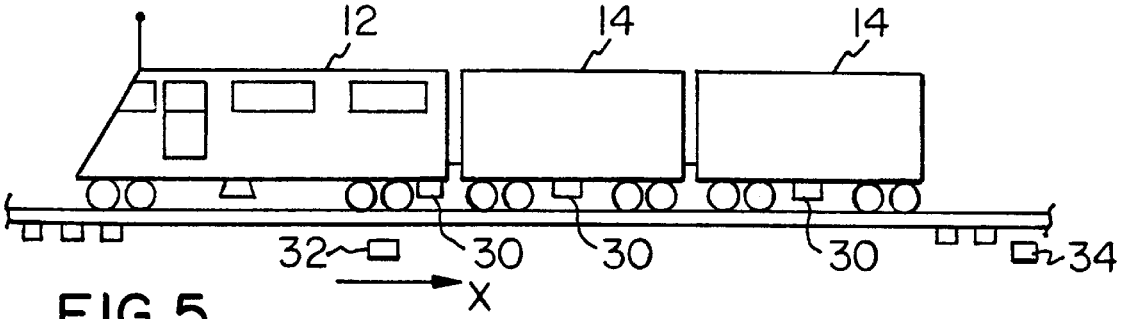
FIG. 5 is a side elevational view similar to FIG. 1 with the train engine in a reversed orientation.
Figure 6:
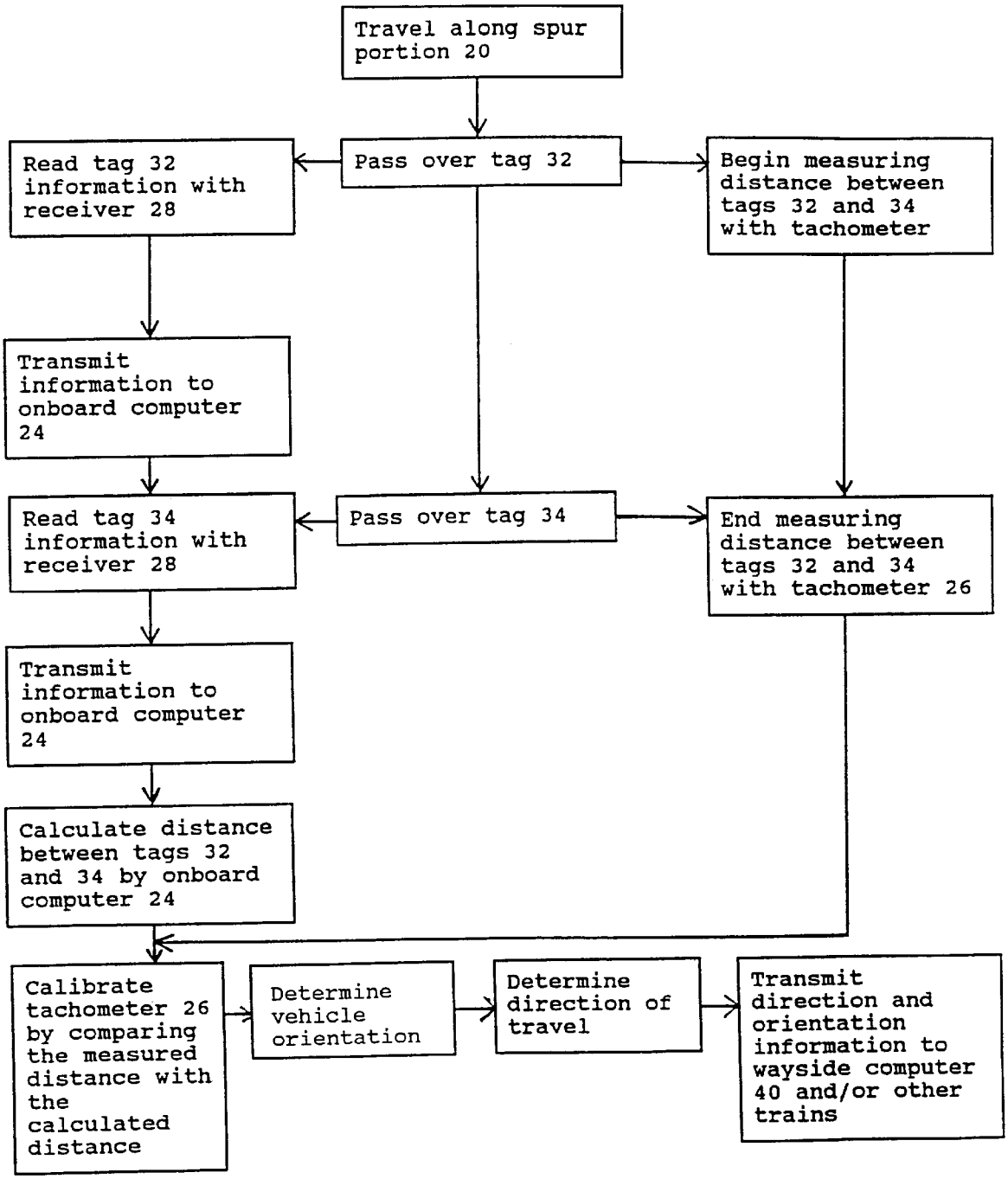
FIG. 6 is a flow diagram representing a portion of the initialization system.

With reference to FIGS. 2–5, in operation, the train 10 is activated and positioned on the spur portion 20 rearwardly (which is to the left) of the tags 32 and 34, the verification reader 36, the wheel detector 38 and the trip stop 42, which is to the right of tags 32 and 34. The train then moves in a forwardly "X" direction and passes over the tags 32 and 34 as schematically represented in FIG. 6. The reader 28 reads the location information transmitted by tags 32 and 34 and the onboard computer 24 identifies the location of the tags 32 and 34 and calculates the distance between the tags 32 and 34. The tachometer 26 simultaneously measures the distance between the tags 32 and 34 and can then be calibrated pursuant to the following equation:

distance between the tags 32 and 34=(the reading on the tachometer)×(a calibration factor).

Further, based upon the sequence in which the train 10 passes over the tags 32 and 34, the onboard computer 24 determines the direction of travel (in this case in the "X" direction). The train would be traveling in the "X'" direction, shown in FIG. 1, had it first traveled over tag 34 and then tag 32. The tachometer reading determines the orientation of the vehicle 12 together with the determined direction of travel. Specifically, as shown in FIG. 4, if the tachometer 26 indicates a positive or clockwise rotation of the wheel axles and the train is traveling in the "X" direction, then the vehicle 12 is pointed in the forwardly direction, as shown in FIG. 1. If the tachometer indicates a negative or counterclockwise rotation of the axles and the train is traveling in the "X" direction, then the vehicle 12 is pointed in a rearwardly direction as shown in FIG. 5. The above sequence describes the initialization process of an equipped vehicle. Collectively, the traits of the vehicles in the train make up the train.

Figure 7A:
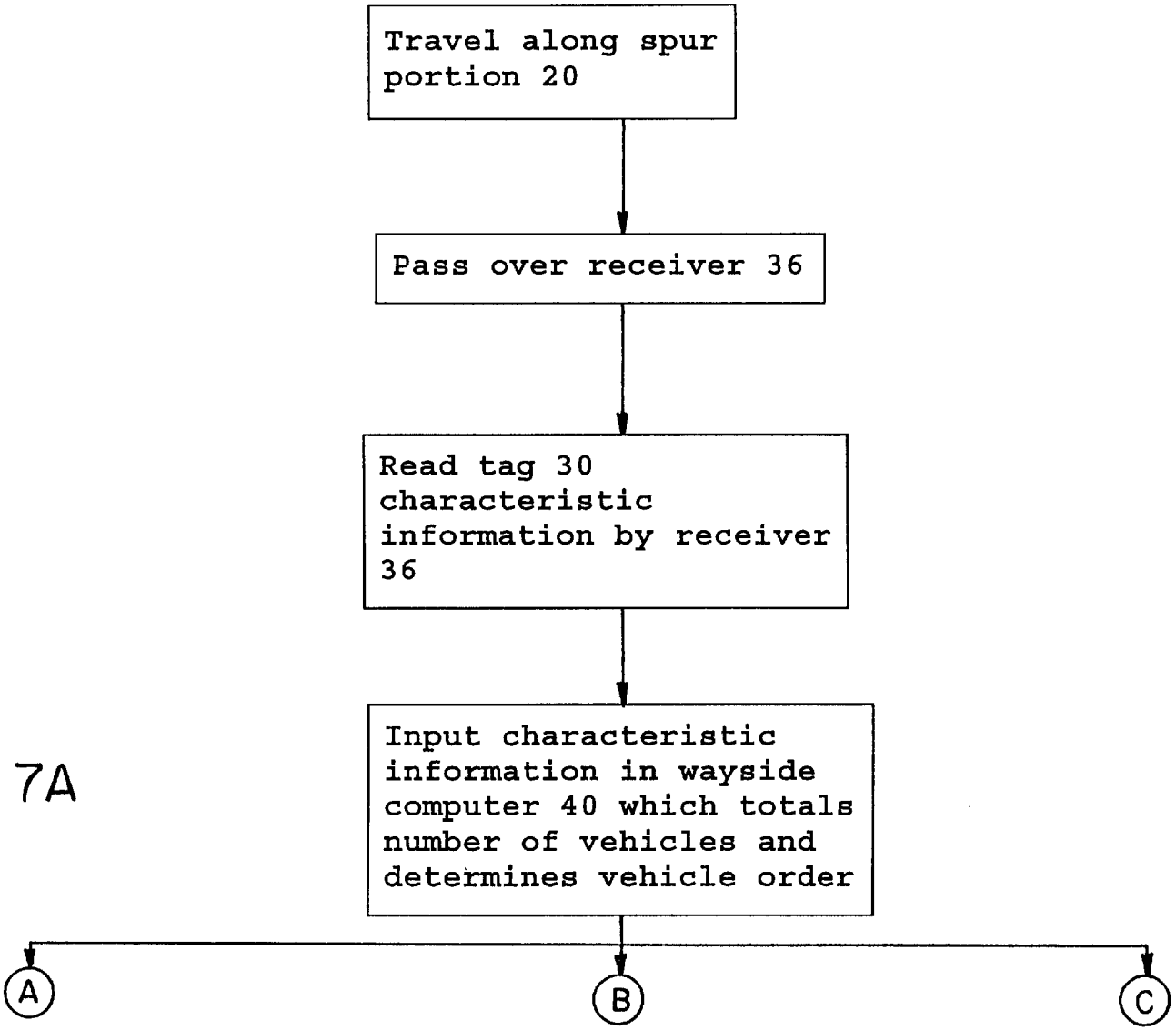
FIGS. 7A, 7B and 7C are flow diagrams representing another portion of the initialization system.
Figure 7B:
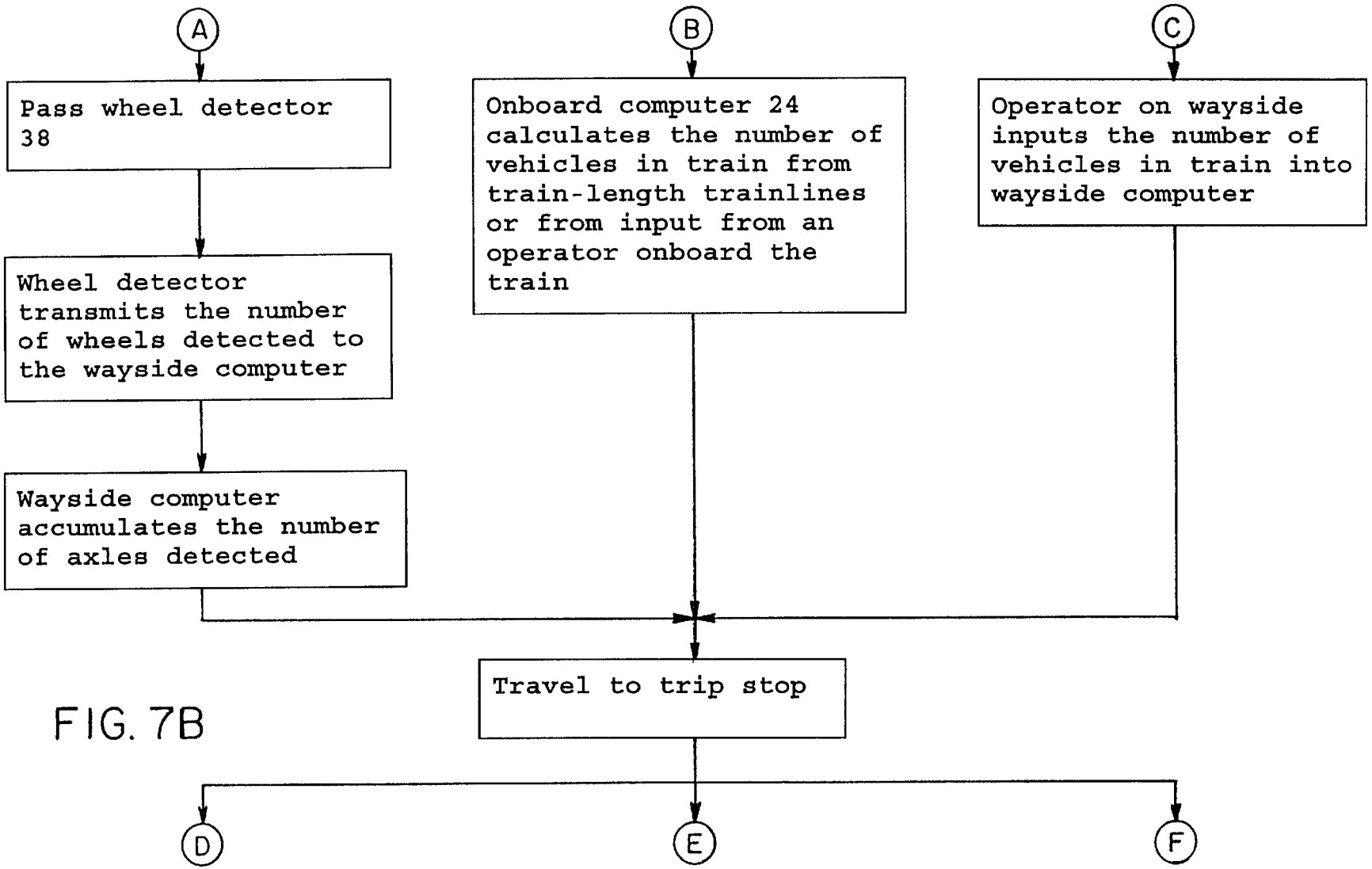
Figure 7C:
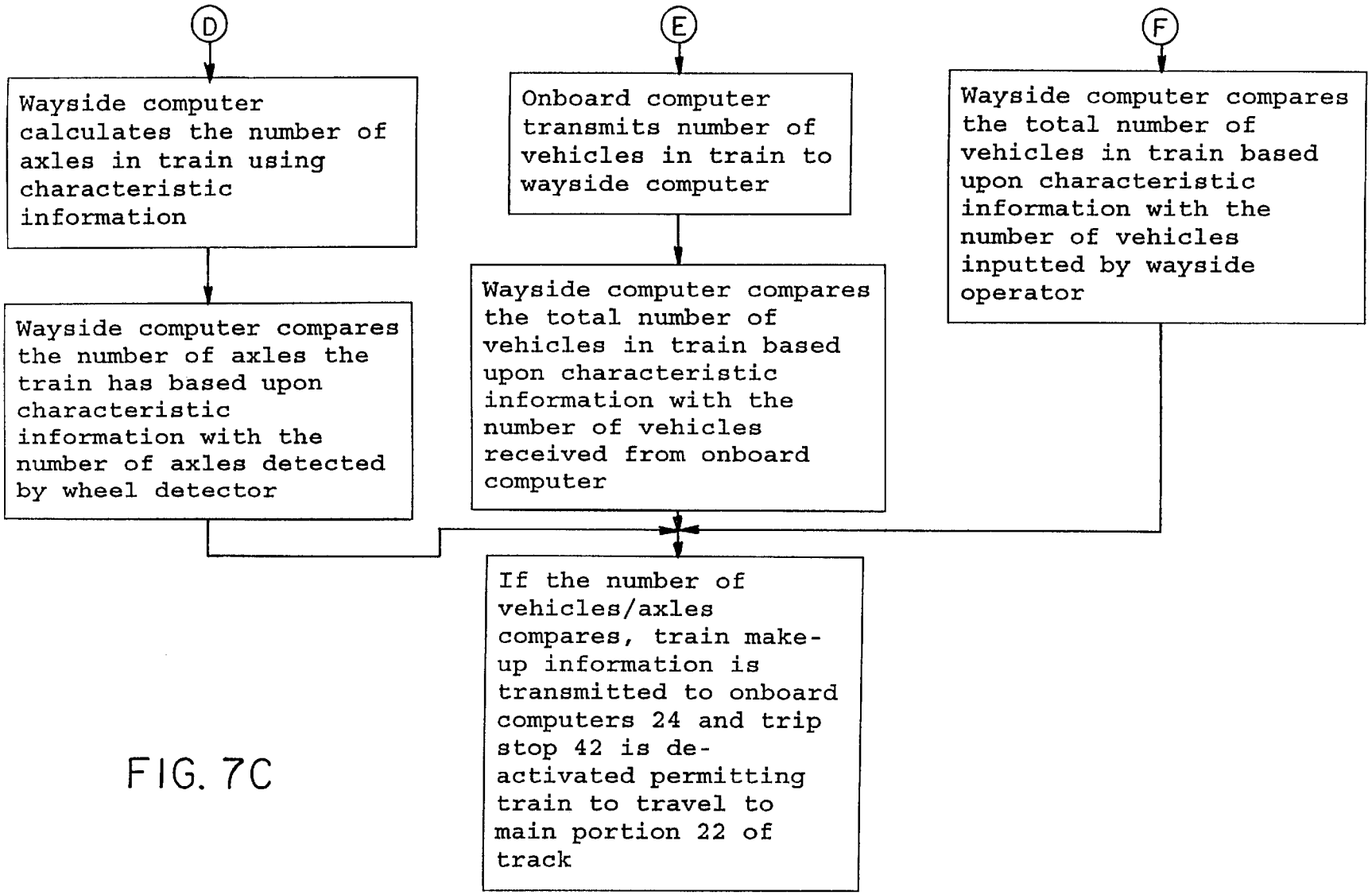

Prior to the train 10 entering the main portion 22 of the track 18, all of the vehicles of the train pass over the verification reader 36, which is schematically represented in FIGS. 7A, 7B and 7C. The verification reader 36 reads the information transmitted or relayed by all of the tags 30 secured to the vehicles 12 and 14. This information is then transmitted or relayed to the wayside computer 40, which calculates the train length. Together with the number of vehicles and their combined performance characteristics, the train characteristic profile is determined, i.e., stopping characteristics and accelerating characteristics, etc. The wayside computer 40 also determines the order of the vehicles 12 and 14, for example, which vehicle is positioned first in the train, which vehicle is positioned second in the train, etc. The wayside computer 40 then calculates the number of axles present on the train 10 based upon, for example, vehicle model information. The verification reader 36 reading vehicle tags 30 constitute a first arrangement for obtaining information regarding train 10, such as, the number of vehicles in the train, the order of the vehicles in the train and the like.

To verify that the information obtained utilizing the verification reader 36 is correct, a second arrangement is provided for determining the train length and/or the number of axles present on the train 10. One such second arrangement includes a wheel detector 38 which physically detects the number of wheels on the train as the train passes thereby. In turn, the number of axles present on the train 10 as detected. This information is transmitted or relayed to the wayside computer 40, which compares the information received from the verification reader 36 and the wheel detector 38. If the wayside computer 40 determines that the information corresponds with each other, that is to say the number of axles calculated from the tag information (of tags 30) supplied to the wayside computer 40 equals the number of axles detected by the wheel detector 38, then the trip stop 42 is deactivated, allowing the train 10 to enter the main portion 22 of the track 18, and other train information, such as, without limitation, train length, numbers of vehicles and vehicle order, is transmitted or relayed by the wayside computer 40 to the onboard computer 24. If, however, the information does not correspond, then the train must be inspected to determine the reason for the difference between the interrogated information and the wheel detector 38. Any discrepancies between the number of vehicles identified by the verification reader 36 and the number of axles identified by the wheel detection must be corrected before the train 10 can enter the main portion 20 of the track 18.

Another second arrangement of verifying the train length and/or the number of axles present on the train 10 includes a train-length trainline connected to the onboard computer 24. The train-length trainline 44 includes an electrically measurable element 46, such as resistor or a switch, positioned on each vehicle 12 and 14 in the train 10 and connected to be sensed by the onboard computer 24. By detecting the presence of these elements 46, the onboard computer 24 can determine the number of vehicles in the train 10 and consequently the train length and/or the number of axles present on the train 10.

Still another second arrangement of verifying the train length and/or the number of axles present on the train 10 includes an onboard train operator inputting into the onboard computer 24, via a keyboard 48, train length information and/or the number of axles present on the train 10 or equivalents thereof whereby the train length and/or number of axles can be derived by the onboard computer 24. Alternatively, a person positioned outside the train 10 can count the number of vehicles in the train, the number of axles and the like, from which the train length and/or number of axles can be derived and then input this information, via a keyboard 54, into the wayside computer 40.

The train length and/or number of axles present on the train 10, obtained utilizing one or more of the above second arrangements, is communicated between the wayside computer 40 and the onboard computer 24. If the wayside computer 40 or the onboard computer 24 determines that the information obtained utilizing the first and second arrangements do not correspond with each other, then the wayside control computer and/or the onboard computer 24 detecting the difference can prevent the train 10 from entering the main portion 22 of the track 18.

In a similar manner, information regarding other initialization factors, such as, without limitation, train direction of travel, train orientation and train location, obtained utilizing the first arrangement and one or more of the second arrangements are communicated between the onboard computer 24 and the wayside computer 40. In the event a discrepancy is detected between the information obtained from the first arrangement and one of the second arrangements, by either the onboard computer 24 or the wayside computer 40, the computer detecting the discrepancy prevents the train 10 from entering the main portion 22 of the track 18. Specifically, if the wayside computer 40 recognizes a lack of correspondence or a discrepancy, the wayside computer 40 activates the trip stop 42 to contact a lever on the train that activates the train brakes. Similarly, if the onboard computer 24 recognizes the discrepancy, the onboard computer 24 initiates action to prevent the train from entering the main portion 22 of the track 18. By way of example, and not of limitation, this action may include, the onboard computer 24 communicating a command to the wayside computer 40 to activate the trip stop 42, the onboard computer 24 activating the train brakes or the onboard computer 24 preventing the propulsion system of the train 10 from supplying motive power to the wheels 16 of the train 10.

During operation of the train 10 on the main portion 22 of track 18, the onboard computer 24 is constantly exchanging or sharing information with the wayside control computers 40 positioned along the path of the train 10. Specifically, the onboard computer 24 of the train 10 transmits or relays information regarding initialization factors and operational aspects of the train 10, such as without limitation, train length and train speed, to the wayside control computers 40. The wayside control computers 40 also receive initialization factors and operational aspects of other trains, e.g., 10', 10" and 10'" operating on the main portion 22 of the track 18. The wayside control computer 40 transmits or relays the initialization factors and operational aspects of the other trains to the onboard computer 24 of the train 10 as it progresses along the main portion 22 of the track 18. In this manner, the train 10 operating on the main portion 22 of the track 18 is dynamically providing information regarding its status to the wayside control computers 40, which, in turn, are dynamically providing to the train 10 information regarding the status of other trains, e.g. 10', 10" and 10'" operating on the main portion 22 of the track 18. Accordingly, information necessary to the operation of a moving block system is communicated between trains operating on the main portion 22 of the track 18 and to trains attempting to enter or exit the main portion 22 of the track 18 and appropriate measures are implemented in the wayside control computers 40 and/or the onboard computers 24 regarding the control and/or safety of trains operating on the track 18.

As is now evident, the present invention permits trains to be initialized prior to entering the main portion 22 of the track 18. This system is especially useful in moving block systems and permits calibration of the tachometer (or other arrangements, such as a Doppler radar), determination of the train direction and orientation of the train prior to the train entering the main portion 22 of the track 18. It is also possible to continuously calibrate the tachometer 26 as it travels along the main portion 22 of the track 18 by comparing the distance between two adjacent tags "T" with the distance measured by the tachometer 26 and calibrating the tachometer 26 in the same manner as it was initially calibrated when the train passed over tags 32 and 34. Further, the initialization permits the "vital" determination of the train length by utilizing two separate systems or arrangements to determine the train's length.

Having described the presently preferred embodiment of the invention, it is to be understood that it may otherwise be embodied within the scope of the appended claims.

We claim:

1. A vehicle initialization system for a vehicle control system, comprising:

a vehicle to be initialized;

a vehicle path adapted to coact with said vehicle;

at least two spaced apart position identifiers positioned along said path, each of said position identifiers adapted to represent information identifying the location of said position identifier along said vehicle path;

a reader attached to said vehicle and adapted to read information from said position identifier;

a computer provided with said vehicle; and means for measuring the distance said vehicle has traveled interfaced with said computer, whereby when said vehicle passes said position identifiers, said position identifiers identify location information to said onboard reader which, in turn, relays the location information to said computer, so that said computer determines the vehicle direction of travel, calculates a distance between said position identifiers and calibrates said means for measuring the distance said vehicle has traveled, and said computer determines the orientation of said vehicle based upon information said computer receives from said means for measuring the distance said vehicle has traveled.

2. A vehicle initialization system as claimed in claim 1, wherein said means for measuring the distance said vehicle has traveled comprises a tachometer.

3. A vehicle initialization system as claimed in claim 1, wherein said means for measuring the distance said vehicle has traveled comprises a radar.

4. A vehicle initialization system as claimed in claim 1, wherein said vehicle is a wheeled vehicle.

5. A vehicle initialization system as claimed in claim 1, wherein said vehicle path comprises a track.

6. A vehicle initialization system as claimed in claim 5, wherein said vehicle comprises a body and wheels secured to said body, said wheels adapted to coact with said track.

7. A vehicle initialization system as claimed in claim 1, wherein said vehicle path includes a main portion and a spur portion, said position identifiers positioned along said spur portion of said vehicle path, whereby said vehicle passes said position identifiers before said vehicle travels on said main portion of said vehicle path.

8. A vehicle initialization system as claimed in claim 1, further comprising means for relaying information related to the vehicle direction of travel and the vehicle orientation to a wayside computer.

9. A vehicle initialization system as claimed in claim 8, further comprising means for receiving the relayed information related to the vehicle direction of travel and the vehicle orientation.

10. A vehicle initialization system as claimed in claim 1, further comprising means for bidirectional communication associated with the computer provided with the vehicle and a wayside computer.

11. A vehicle initialization system as claimed in claim 10, further comprising means for enabling the computer provided with the vehicle to determine the length of the vehicle.

12. A vehicle initialization system as claimed in claim 11, wherein the means for enabling the computer provided with the vehicle to determine the length of the vehicle includes a train-length trainline.

13. A vehicle initialization system as claimed in claim 10, wherein information regarding the length of the vehicle is entered into at least one of said computer provided with said vehicle and said wayside computer via means for data entry, and wherein the entered information regarding the length of the vehicle is communicated between said vehicle computer and said wayside computer.

14. A method for initializing a vehicle on a vehicle path, comprising the steps of:

a) positioning a vehicle on a vehicle path;

b) moving said vehicle on said vehicle path;

c) moving said vehicle over a first fixed point of reference;

d) identifying a location of the first fixed point of reference;

e) moving said vehicle over a second fixed point;

f) identifying a location of the second fixed point;

g) measuring the distance between the first fixed point and the second fixed point by a distance measuring device provided on the vehicle;

h) calculating the distance traveled by the vehicle between the first fixed point and the second fixed point, based upon the identified locations;

i) calibrating the distance measuring device so that the measured distance between the first fixed point and the second fixed point equals the calculated distance;

j) determining the vehicle's direction of travel based upon the sequence the vehicle passes over said fixed points; and k) determining the orientation of said vehicle using the distance measuring device and the determined vehicle's direction of travel.

15. A method for initializing a vehicle on a vehicle path as claimed in claim 14, wherein the vehicle path comprises a spur portion and a main portion, the first fixed point and the second fixed point are positioned along the spur portion of the vehicle path, said vehicle travels the spur portion prior to said vehicle entering the main portion of the vehicle path.

16. A method for initializing a vehicle on a vehicle path as claimed in claim 15, further comprising:

relaying the vehicle direction and vehicle location to wayside receiving means prior to the vehicle entering onto the main portion of the vehicle path.

17. A method for initializing a vehicle on a vehicle path as claimed in claim 16, further comprising the step of relaying the vehicle location to other vehicles.

18. A vehicle initialization system for vehicle control system, comprising:

a vehicle to be initialized;

a vehicle path adapted to coact with said vehicle, said vehicle path including a spur portion and a main portion, wherein said vehicle travels from said spur portion onto said main portion;

a vehicle identifier adapted to identify vehicle characteristics, said vehicle identifier attached to said vehicle;

a reader positioned along said spur portion, said reader adapted to read said vehicle identifier as said vehicle travels along said spur portion;

a computer interfaced with said reader and adapted to have data relayed from said reader inputted therein, said data identifying characteristics of said vehicle;

identifying means for identifying at least one characteristic of said vehicle as said vehicle travels along said spur portion, said identifying means interfaced with said computer; and preventing means for preventing said vehicle from entering said main portion of said vehicle path if said vehicle characteristic identified by said identifying means does not correspond with one of said vehicle characteristics identified by said vehicle identifier.

19. A vehicle initialization system as claimed in claim 18, wherein said vehicle path comprises a track.

20. A vehicle initialization system as claimed in claim 19, wherein said vehicle comprises a body having wheels rotatably secured thereto, said wheels adapted to coact with said track.

21. A vehicle initialization system as claimed in claim 18, wherein said system includes a plurality of vehicles attached to each other, each of said vehicles having a vehicle identifier adapted to identify vehicle characteristics attached thereto, wherein said preventing means prevents said vehicles from entering the vehicle path if at least one characteristic of said vehicles identified by said identifying means does not correspond with one of said vehicle characteristics identified by said vehicle identifier.

22. A vehicle initialization system as claimed in claim 18, wherein said preventing means comprises a trip stop.

23. A vehicle initialization system as claimed in claim 18, wherein one of said vehicle characteristics is the number of axles provided on said vehicle along the length of said vehicle.

24. A vehicle initialization as claimed in claim 18, wherein one of said vehicle characteristics is the length of said vehicle.

25. A vehicle initialization system for a vehicle control system, comprising:

a vehicle to be initialized;

a vehicle path adapted to coact with said vehicle;

at least two spaced apart position identifiers positioned along said path, each of said position identifiers adapted to represent information identifying a location of said position identifiers along said vehicle path;

a first reader attached to said vehicle and adapted to read information from said position identifier;

an onboard computer provided with said vehicle interfaced with said first reader, said onboard computer adapted to receive data from said first reader;

means for measuring the distance said vehicle has traveled interfaced with said onboard computer, whereby when said vehicle passes said position identifiers, said position identifiers identify location information to said first reader and said first reader relays the location information as data, which is inputted into said onboard computer so that said onboard computer determines a vehicle direction of travel, determines a distance between said position identifiers, calibrates said means for measuring the distance said vehicle has traveled and determines the orientation of said vehicle based upon information said onboard computer receives from said means for measuring the distance said vehicle has traveled;

a vehicle identifier adapted to identify vehicle characteristics, said vehicle identifier attached to said vehicle;

identifying means for identifying at least one characteristic of said vehicle as said vehicle travels along said vehicle path, said identifying means interfaced with a wayside computer; and means for preventing said vehicle from proceeding along said vehicle path if said vehicle characteristic identified by said identifying means does not correspond with one of said vehicle characteristics identified by said vehicle identifier.

26. The vehicle initialization system as claimed in claim 25, wherein said vehicle identifier includes a train-length trainline connected to said onboard computer which obtains vehicle characteristics from said train-length trainline and determines therefrom at least one of the vehicle length and the number of axles present on the vehicle.

27. The vehicle initialization system as claimed in claim 25, further including:

a second reader positioned along said vehicle path which is adapted to read said vehicle identifier as said vehicle travels along said vehicle path, said wayside computer interfaced with said second reader and adapted to have data relayed from said second reader inputted therein, said data identifying characteristics of said vehicle.

28. The vehicle initialization system as claimed in claim 27, wherein said vehicle identifier includes a tag which emits signals and wherein said identifying means includes a wheel detector which counts the number of axles on the vehicle as the vehicle passes by the wheel detector.

29. The vehicle initialization system as claimed in claim 28, wherein said onboard computer and said wayside computer compare vehicle characteristics obtained from said second reader reading said tags and vehicle characteristics obtained from one of said wheel detector and a train-length trainline connected to said onboard computer, and prevent said vehicle from proceeding along said vehicle path in response to at least one of said onboard computer and said wayside computer determining a difference between vehicle characteristics obtained from said second reader and the one of said wheel detector and said train-length trainline.

30. The vehicle initialization system as claimed in claim 25, wherein at least one of said onboard computer and said wayside computer have means for operator input which allows an operator to input vehicle characteristic information.

31. The vehicle initialization system as claimed in claim 25, wherein said onboard computer and said wayside computer each include a radio frequency transceiver which enables the transmission and receiving of information therebetween.

32. A method for initializing a vehicle on a vehicle path having a spur portion and a main portion, comprising the steps of:

a) providing a vehicle with a vehicle identifier identifying vehicle characteristics;

b) positioning said vehicle on a spur portion of a vehicle path;

c) moving said vehicle on said spur portion of said vehicle path;

d) verifying at least one of said vehicle characteristics while said vehicle is positioned on said spur portion of said vehicle path; and e) stopping said vehicle on said spur portion of said vehicle path prior to entering said main portion of said vehicle path if at least one of said vehicle characteristics is not verified.

33. A vehicle initialization system for a vehicle control system, comprising:

a vehicle to be initialized;

a vehicle path adapted to coact with said vehicle;

a vehicle identifier attached to said vehicle and adapted to identify characteristics of said vehicle;

a reader positioned along said vehicle path and adapted to read said vehicle identifier as said vehicle travels along said path;

a wayside computer interfaced with said reader and adapted to have data relayed from said reader inputted therein, said data identifying characteristics of said vehicle;

means for identifying characteristics of said vehicle;

a vehicle computer provided with said vehicle, said vehicle computer adapted to identify characteristics of the vehicle relayed to said vehicle computer from said means for identifying; and means for preventing said vehicle from proceeding down said vehicle path if said vehicle characteristics identified by said vehicle computer does not correspond with at least one of said vehicle characteristics identified by said wayside computer.

34. The vehicle initialization system as claimed in claim 33, wherein the means for identifying includes a train-length trainline.

35. The vehicle initialization system as claimed in claim 34, wherein said train-length trainline includes an electrically measurable element attached to said vehicle and adapted to identify characteristics of the vehicle.

36. The vehicle initialization system as claimed in claim 35, wherein the characteristics of said vehicle determined from the electrically measurable element includes at least one of the vehicle length and the number of axles present on the vehicle.

37. The vehicle initialization system as claimed in claim 33, wherein said means for identifying includes a wheel detector which detects the number of axles on said vehicle as said vehicle passes thereby.

38. The vehicle initialization system as claimed in claim 33, wherein at least one said vehicle computer and said wayside computer have means for operator input which allow an operator to input vehicle characteristics thereinto.

39. The vehicle initialization system as claimed in claim 33, wherein said vehicle computer and said wayside computer each include a radio frequency transceiver which enables the transmission and receiving of information therebetween.

40. The vehicle initialization system as claimed in claim 39, wherein said vehicle computer and said wayside computer compare vehicle characteristics obtained from said vehicle identifier and said means for identifying and prevent said vehicle from proceeding along said vehicle path in response to at least one of said onboard computer and said wayside computer determining a difference between the vehicle characteristics obtained from said vehicle identifier and said means for identifying.

41. A method for initializing a vehicle on a vehicle path, comprising the steps of:

a) providing a vehicle with a vehicle identifier identifying vehicle characteristics;

b) positioning a vehicle on a vehicle path;

c) moving the vehicle on the vehicle path;

d) moving the vehicle over a first fixed point of reference;

e) identifying a location of the first fixed point of reference;

f) moving the vehicle over a second fixed point;

g) identifying a location of the second fixed point;

h) measuring the distance between the first fixed point and the second fixed point by a distance measuring device provided on the vehicle;

i) calculating the distance traveled by the vehicle between the first fixed point and the second fixed point based upon the identified locations;

j) calibrating the distance measuring device so that the measured distance between the first fixed point and the second fixed point equals the calculated distance;

k) determining the vehicle's direction of travel based upon the sequence the vehicle passes over said fixed points;

l) determining the orientation of the vehicle using the distance measuring device and the determined vehicle's direction of travel;

m) verifying at least one of the vehicle characteristics; and n) stopping the vehicle if at least one of the vehicle characteristics is not verified.

42. A method for initializing a vehicle on a vehicle path, comprising the steps of:

a) providing a vehicle with a vehicle identifier identifying vehicle characteristics, including a vehicle length;

b) positioning the vehicle on a vehicle path;

c) moving the vehicle on the vehicle path;

d) verifying the vehicle length; and e) stopping the vehicle if the vehicle length is not verified.

* * * * *